United States Patent [19]

van der Linden et al.

[11] 3,987,092

[45] Oct. 19, 1976

[54] PROCESS FOR THE PREPARATION OF A SALT OF OPTICALLY ACTIVE LYSINE

[75] Inventors: Willem K. van der Linden; Geertrudes H. Suverkropp, both of Geleen, Netherlands

[73] Assignee: Stamicarbon N.V., Geleen, Netherlands

[22] Filed: Oct. 2, 1969

[21] Appl. No.: 864,951

[30] Foreign Application Priority Data

Oct. 2, 1968 Netherlands ..... 6814129

[52] U.S. Cl. ..... 260/501.12

[51] Int. Cl.[2] ..... C07C 143/00

[58] Field of Search ..... 260/501.12

[56] References Cited

UNITED STATES PATENTS 3,527,776 9/1970 Uzuri et al. ..... 260/501.12

OTHER PUBLICATIONS

Stearn(II) J. Chem. Physiol. vol. 10, pp. 325–336 (1926).

Stearn(III) J. Chem. Physiol. vol. 10, pp. 369–377 (1926).

Stearn, Chemical Abstracts vol. 21 (1927) p. 1131.

*Primary Examiner*—Gerald A. Schwartz

*Attorney, Agent, or Firm*—Cushman, Darby & Cushman

[57] ABSTRACT

Lysine is optically resolved by forming a salt with sulphanilic acid and selectively crystallizing one of the antipodes from a supersaturated solution thereof. The salt of lysine and sulphanilic acid is a novel compound.

7 Claims, No Drawings

PROCESS FOR THE PREPARATION OF A SALT OF OPTICALLY ACTIVE LYSINE

This invention relates to a process for the preparation of a salt of optically active lysine and an optically inactive acid by first preparing a mixture of optical antipodes of the salt and subsequently effecting an optical resolution by subjecting a supersaturated solution of the mixture of antipodes to selective crystallization.

A process of this type, which is of importance for preparing optically active lysine, can be effected in a known manner, using 3,5-dinitrobenzoic acid, anthrachinone-β-sulphonic acid, 1-chloronaphthalene 4-sulphonic acid or β-naphthalenesulphonic acid as the optically inactive acid. These acids have the drawback, however, that they are rather expensive and, with the exception of the 3,5-dinitrobenzoic acid, give only moderate results as far as the yield and the optical purity of the optically active lysine salt desired is concerned. A further drawback which renders the use of the 3,5-dinitrobenzoic acid less attractive is the fact that in the case of racemization of the non-desired optically active lysine salt strong decomposition takes place.

It has now been found that sulphanilic acid (para-aminobenzenesulphonic acid) is particularly suited for being used as optically inactive acid. Sulphanilic acid is considerably cheaper than the aforementioned acids, while no decomposition takes place in the case of racemization of the non-desired optically active lysine salt. A further advantage is that the yield and the optical purity of the optically active lysine salt of sulphanilic acid are very satisfactory.

The invention provides a highly practical process for the preparation of a salt of optically active lysine and an optically inactive acid comprising an optical resolution effected by selective crystallization, which process is characterized in that a mixture of optical antipodes of the salt of lysine and sulphanilic acid is subjected to an optical resolution by selective crystallization from the supersaturated solution concerned. The lysine salt of sulphanilic acid (lysine sulphanilate) can be prepared by known methods, for instance by dissolving the amount of sulphanilic acid required in an aqueous lysine solution and evaporating the aqueous solution thus obtained to dryness or by dissolving the amount of sulphanilic acid required in an aqueous lysine carbonate solution with simultaneous formation and discharge of carbon dioxide an evaporating the aqueous solution thus obtained to dryness. Lysine sulphanilate can also be prepared by dissolving the ammonium salt of sulphanilic acid in an aqueous lysine solution and evaporating the solution thus obtained to dryness with simultaneous discharge of ammonia.

The supersaturated solution of lysine sulphanilate required for effecting the optical resolution by selective crystallization, can be obtained in a known way, for instance by cooling or evaporation of a saturated solution of lysine sulphanilate.

Water is a very suitable solvent for the selective crystallization from the supersaturated solution of lysine sulphanilate and is in fact preferred for that purpose. It is also possible, however, to use other solvents, e.g. mixtures of water with an organic solvent such as methanol, ethanol, propanol, acetone or butanone.

The selective crystallization can be effected by seeding the supersaturated solution with crystals of the optically active lysine sulphanilate to by crystallized or by passing the said solution over a fixed bed consisting of the optically active lysine sulphanilate to be crystallized. In the event that one of the two antipodes of lysine sulphanilate is present in the supersaturated solution in a larger amount than the other, the first-mentioned antipode may spontaneously crystallize out. In this case the selective crystallization is preferably also effected, however, by contacting the supersaturated solution with crystals of the antipode to be crystallized.

In practice, the process according to the invention can be carried out by application of known procedures used for optical resolution by selective crystallization; various conditions, such as the degree of supersaturation, the crystallization time, the crystallization temperature, and the size and the amount of the seeding crystals, may be varied. It is possible, for instance, to divide the supersaturated solution into two equal portions, selectively to crystallize an amount of the L-antipode from one of the said portions and an equal amount of D-antipode from the other, and, finally, to recycle the two mother liquors left over, upon mixing, to the preparation stage of the supersaturated starting solution. It is also possible selectively to crystallize an amount of one of the antipodes from the supersaturated solution and subsequently selectively to crystallize an amount of the other antipode from the mother liquor left over, after which the mother liquor which is then left over can be used in the preparation of the supersaturated starting solution. It is furthermore possible to use a third procedure. It has been found that L- or D-lysine sulphanilate is insoluble in a solution which is saturated or substantially saturated with racemic lysine sulphanilate, so that the mother liquor left over upon selective crystallization of an amount of one of the antipodes, can be processed by saturating or substantially saturating it with racemic lysine sulphanilate, as a result of which an amount of the other antipode is obtained in the solid state.

According to the invention, the non-desired optically active lysine sulphanilate can be very efficiently racemized by heating an aqueous solution of this salt for a period of time, for example for 1 hour, at a temperature of about 200° C.

The optical purity of the optically active lysine sulphanilate obtained by the process according to the invention, which depends on the conditions under which the optical resolution is effected, can, if so desired, even be increased by treating the lysine sulphanilate concerned with a solvent for effecting the formation of a solid phase by the side of a saturated or virtually saturated liquid phase. The solid phase will then contain optically active lysine sulphanilate whose optical purity is higher than that of the original optically active lysine sulphanilate. The said treatment can be carried out by extracting the optically impure lysine sulphanilate with the solvent or by dissolving the optically impure lysine sulphanilate in the solvent and subsequently subjecting the solution to crystallization. Any solvent can be employed in which racemic lysine sulphanilate can be dissolved. Water or mixtures of water and one or more organic solvents such as methanol, ethanol, propanol, acetone and butanone have proved to be very suitable for this purpose.

The method found for increasing the optical purity of optically impure lysine sulphanilate can of course also be applied if the optically impure lysine sulphanilate has been obtained in a manner other than by optical resolution of lysine sulphanilate by the selective crystallization method, e.g. by reaction of sulphanilic acid with optically impure lysine. The invention therefore includes a process for the preparation of a salt of optically active lysine and an optically inactive acid which is characterized in that a mixture of unequal quantities of the D- and the L-antipode of the lysine salt of sulphanilic acid is prepared, subsequently a solid phase and a saturated or substantially saturated liquid phase is formed by treating the salt mixture obtained with a solvent, and finally the solid phase, which mainly consists of the antipode present in the larger amount, is separated from, the liquid phase.

The optically active lysine sulphanilate according to the invention can be split into its components in several ways, for instance by passing an aqueous solution of the salt over a weakly basic ion exchanger. The sulphanilic acid is then bound to the ion exchanger, a lysine solution being obtained as the eluate. It is also possible to pass an aqueous solution of the optically active lysine sulphanilate over a strong acid ion exchanger in the form of $NH_4^+$. The lysine is then bound to the ion exchanger and can be eluted with dilute ammonia water.

The invention will be further elucidated by means of the following examples, without being restricted thereto.

EXAMPLE I

The salt of DL-lysine and sulphanilic acid was prepared by adding 363.7 grams of sulphanilic acid to a solution of 306 grams of DL-lysine in 494 grams of water, heating the mixture until a clear solution was obtained, cooling the said solution to room temperature with simultaneous crystallization, and finally evaporating the mixture to dryness at about 45° C at reduced pressure.

Thus, 669 grams of a solid substance which from chromatographic analysis, consisted of lysine sulphanilate, was obtained. The melting range, determined upon recrystallization from water, was 233°–235° C.

EXAMPLE II 30 grams of racemic lysine sulphanilate were dissolved in 35.2 grams of water with simultaneous heating, after which the solution obtained is cooled to 26° C to obtain a supersaturated solution. 1 gram of solid L-lysine sulphanilate (crystal diameter ranging from 0.050 to 0.105 millimeter) was added to the supersaturated solution, the resulting suspension being stirred for 15 minutes at 26° C. Subsequently, the L-lysine sulphanilate which had crystallized out was separated from the mother liquor by filtration and dried. 3.8 grams of substantially chemically pure L-lysine sulphanilate were thus obtained.

To determine the optical purity of the L-lysine sulphanilate obtained, the salt was converted into L-lysine monohydrochloride. To this end, the 3.8 grams of L-lysine sulphanilate obtained were dissolved in 15 milliliters of water, the resulting solution being passed across a column filled with about 50 milliliters of strong acid ion exchanger (Dowex 50) in the form of $NH_4^+$. The column was flushed with water until no ammonium sulphanilate was contained in the eluate any more. The lysine bound to the ion exchanger was then eluted with 3.5 N ammonia water, after which the eluate obtained was concentrated at reduced pressure to remove the ammonia. The lysine solution thus obtained was neutralized with the amount of hydrochloric acid required and then completely evaporated to dryness.

2.15 grams of L-lysine monohydrochloride having a specific rotation $$|\alpha|_D^{20} = +22.3 \ (c = 10.6 \text{ N HCl})$$

were thus obtained. Hence it follows that the optical purity of the L-lysine sulphanilate amounted to 91.1 % (82.3 % by weight of the L-component together with 17.7 % by weight of the DL-component).

EXAMPLE III 30 grams of racemic lysine sulphanilate was dissolved in 35.2 grams of water with simultaneous heating, the resulting solution being cooled to 26° C to obtain a supersaturated solution. 1 gram of L-lysine sulphanilate crystals was then added, after which the resulting suspension was stirred for 30 minutes at 26° C. The L-lysine suphanilate crystallized out was then filtered and washed on the filter with 10 milliliters of methanol.

4.1 grams of L-lysine sulphanilate having an optical purity of 96.5 % were thus obtained.

The filtrate obtained, which contain 24.08 grams of DL-lysine sulphanilate and 2.82 grams of D-lysine sulphanilate, was partly evaporated to remove the methanol. The solution left over was made up with water to 62.6 grams and then heated to 41° C. After that, 6.32 grams of solid DL-lysine sulphanilate was added to the solution, the resulting suspension being stirred for 1 hour at 41° C. Finally, the solid phase was separated from the liquid.

3.22 grams of solid D-lysine sulphanilate with an optical purity of 93.8 % were thus obtained. The liquid phase left over, which weighs 65.2 grams and contains 46 % by weight of DL-lysine sulphanilate, was again subjected to a selective crystallization.

EXAMPLE IV 30 grams of racemic lysine sulphanilate were dissolved in 33.2 grams of water with simultaneous heating, the resulting solution being cooled to 26° C to obtain a supersaturated solution. 1 gram of L-lysine sulphanilate crystals was then added, after which the resulting suspension was stirred for 15 minutes at 26° C.

After the solid matter was filtered off, washed and dried, 4.5 grams of L-lysine sulphanilate with an optical purity of 90.7 % were obtained.

EXAMPLE V 30 grams of racemic lysine sulphanilate were dissolved in 35.2 grams of water with simultaneous heating. The resulting solution was cooled to 40° C. 1 gram of L-lysine sulphanilate crystals was then added, the resulting suspension being cooled to such a degree with simultaneous stirring that the temperature decreased by 1° C per 4 minutes. After a temperature of 26° C was reached, the suspension was filtered off and the solid matter dried. 4.25 grams of L-lysine sulphanilate with an optical purity of 91.5 % were thus obtained.

EXAMPLE VI 30 grams of racemic lysine sulphanilate were dissolved in 30 grams of water with simultaneous stirring. The resulting solution was cooled to 40° C. 1 gram of L-lysine sulphanilate crystals was then added, the resulting suspension being stirred for 30 minutes at 40° C.

The L-lysine sulphanilate which crystallized out was then filtered off and washed on the filter with 10 milliliters of methanol. Upon drying, 4 grams of L-lysine sulphanilate with an optical purity of 90.5 % were obtained.

EXAMPLE VII 30 grams of racemic lysine sulphanilate were dissolved in 38.2 grams of water with simultaneous stirring. The resulting solution was cooled to 20° C. The supersaturated solution thus obtained was seeded with 1 gram of L-lysine sulphanilate, the resulting suspension being stirred for 30 minutes at 20° C. After the solid substances was filtered off, washed and dried, 4.3 grams of L-lysine sulphanilate with an optical purity of 97.8 % were obtained.

EXAMPLE VIII 20 grams of L-lysine sulphanilate with an 85 % optical purity were well stirred with a mixture of 70 grams of methanol and 30 grams of water for 1 hour at the boiling temperature of the mixture with the object of improviding the optical purity. The non-dissolved solid matter was filtered off and dried. 11 grams of L-lysine sulphanilate with an optical purity of 99.2 % were thus obtained.

EXAMPLE IX 10 grams of L-lysine sulphanilate with an optical purity of 90 % were dissolved in 21 milliliters of water at about 50° C. 20 grams of acetone were added to the hot solution, after which the latter was slowly cooled to 22° C. The solid substance which crystallized out was filtered off, washed on the filter with a small amount of an acetone-water mixture (70 % by weight of acetone), and finally dried. 7 grams of L-lysine sulphanilate with an optical purity of 98.5 % were thus obtained.

What is claimed is:

1. A process for preparing an optically active form of lysine sulphanilate comprising 1. forming a supersaturated aqueous solution of a racemic mixture of optical antipodes of the salt of lysine and sulphanilic acid,
2. effecting an optical resolution of said supersaturated aqueous solution of said salt mixture, by contacting said supersaturated solution with crystals of an optical active form of lysine sulphanilate, whereby a crystalline mass of optically-active lysine sulfanilate is formed,
3. separating the crystallized salt from the mother liquor, and
4. preparing part of the said starting mixture of optical antipodes of step (1) by heating an aqueous solution containing an optically active lysine sulphanilate, thereby effecting racemization of said optically active lysine sulphanilate.

2. The process of claim 1 wherein the mother liquor of step (3) is substantially saturated with the racemic salt of lysine and sulphanilic acid to form solid and liquid phases, and thereafter separating the solid phase of essentially pure D-lysine sulphanilate from the liquid phase.

3. A process for preparing an optically active form of lysine sulfanilate comprising the steps of 1. forming a mixture of unequal quantities of the D- and L-antipode of the lysine salt of sulphanilic acid,
2. treating said salt with a solvent selected from the group consisting of water, or a mixture of water and at least one organic solvent selected from the group consisting of methanol, ethanol, propanol, acetone, butanone and mixtures thereof, to effect the formation of a solid phase and a substantially-saturated liquid phase, and
3. separating the solid phase consisting essentially of the salt of the antipode present in the larger amount of the starting antipode mixture.

4. A process for preparing an optically active form of lysine sulphanilate comprising 1. forming a supersaturated aqueous solution of a mixture of optical antipodes of the salt of lysine and sulphanilic acid,
2. effecting an optical resolution of the said salt mixture by contacting said supersaturated solution with crystals of an optically active lysine sulphanilate to form a crystalline mass of one optical antipode form of lysine sulphanilate,
3. separating the crystallized salt from the mother liquor,
4. saturating the mother liquor with racemic lysine sulphanilate to effect crystallization of the other optical antipode form of lysine sulphanilate,
5. recovering the said solid and recycling the mother liquor to effect formation of an additional supersaturated solution of a mixture of optical antipodes of lysine sulphanilate and
6. preparing part of the said starting mixture of optical antipodes by heating an aqueous solution containing an optically active lysine sulphanilate, thereby effecting racemization of the optically active lysine sulphanilate.

5. A process for preparing an optically active form of lysine sulphanilate comprising the steps of:

1. forming a saturated aqueous solution of a salt mixture of optical antipodes of lysine sulphanilate wherein one of said antipodes is predominant;
2. forming a supersaturated solution of saturated solution (1) by cooling or evaporation, and effecting crystallization the predominant lysine sulphanilate,
3. recovering the crystalline lysine sulphanilate from the solution, and
4. preparing part of the salt mixture of optical antipodes by heating the solution of step (3), thereby effecting racemization of the optically active lysine sulphanilate.

6. A process for preparing an optically active form of lysine sulphanilate comprising the steps of:

1. forming a supersaturated aqueous solution of a salt mixture of optical antipodes of lysine sulphanilate wherein one of the antipodes is predominant;
2. effecting an optical resolution of said salt mixture by said solution by seeding with crystals of the predominant antipode present in solution (1);
3. recovering optically active lysine sulphanilate crystallized in step (2) by separation from the aqueous mother liquor, and
4. preparing a part of the sale mixture of step (1) by heating the aqueous mother liquid containing one of the optical active salt forms resulting from step (3), thereby effecting racemization of the optically active lysine sulphanilate.

7. A process for resolving DL-lysine-p-aminobenzenesulfonate comprising the steps of preparing a supersaturated solution of dL-lysine-p-aminobenzenesulfonate in water, contacting the supersaturated solution with crystals of the desired enantiomer of the DL-lysine-p-aminobenzenesulfonate to cause crystallization of the desired enantiometer to take place, and recovering the separated crystals, repeating said process a plurality of times to successively and alternately separate said desired enantiomer and said other enantiomer from said racemic modification, including the further step of heating an aqueous solution of one of the optically active enantiomers thus obtained to produce the racemic modification.

* * * * *